US005607343A

United States Patent [19]

Keith, Jr. et al.

[11] Patent Number: 5,607,343

[45] Date of Patent: Mar. 4, 1997

[54] SANDER VIBRATION ISOLATOR

[75] Inventors: James A. Keith, Jr., Pickens; William S. Ballew, Greer, both of S.C.

[73] Assignee: Ryobi North America, Easley, S.C.

[21] Appl. No.: 294,107

[22] Filed: Aug. 22, 1994

[51] Int. Cl.[6] ..... B24B 23/00

[52] U.S. Cl. ..... 451/344; 451/354

[58] Field of Search ..... 451/163, 344, 451/351, 354, 356, 357, 441

[56] References Cited

U.S. PATENT DOCUMENTS

| | | | |
|---|---|---|---|
| 2,350,098 | 5/1944 | Decker . | |
| 3,831,278 | 8/1974 | Voglesonger . | |
| 3,886,716 | 6/1975 | Sellers . | |
| 3,934,344 | 1/1976 | Inaga . | |
| 4,136,446 | 1/1979 | Tripp . | |
| 4,140,446 | 2/1979 | Fernstrom et al. . | |
| 4,211,004 | 7/1980 | Woods . | |
| 4,268,233 | 5/1981 | Fernstrom . | |
| 4,391,041 | 7/1983 | Porter-Bennett . | |
| 4,635,732 | 1/1987 | Gotsch et al. . | |
| 4,759,128 | 7/1988 | Katoh et al. . | |
| 4,817,738 | 4/1989 | Dorner et al. . | |
| 4,819,742 | 4/1989 | Driggers . | |
| 4,825,548 | 5/1989 | Driggers . | |
| 4,905,420 | 3/1990 | Flachenecker | 451/344 |
| 4,905,772 | 3/1990 | Honsa et al. . | |
| 4,920,702 | 5/1990 | Kloss et al. . | |
| 5,123,216 | 6/1992 | Kloss | 451/344 |
| 5,319,889 | 6/1994 | Rudolf et al. . | |
| 5,375,666 | 12/1994 | Pettet et al. . | |

FOREIGN PATENT DOCUMENTS

| | | | |
|---|---|---|---|
| 2742062 | 5/1981 | Germany . | |
| 3840974 | 6/1990 | Germany . | |
| 9307589 | 8/1993 | WIPO . | |
| 93/25346 | 12/1993 | WIPO | 451/344 |

*Primary Examiner*—Jack W. Lavinder
*Attorney, Agent, or Firm*—Brooks & Kushman P.C.

[57] ABSTRACT

A vibration stabilizer is provided for a power tool such as a sander or the like which has a pivotally oscillating driveshaft for supporting a tool head. The tool is provided with an elongate body having an internal cavity aligned along a longitudinal axis for receiving a drive motor therein. A driveshaft is pivotally supported upon the elongate body rotatable about a pivot axis. The drive motor operatively engages the driveshaft to cause the driveshaft to pivotally oscillate within a limited angular range when the drive motor is energized. Relative vibration between the tool head and the elongate body is minimized by an elastic ring which extends about the driveshaft and is interposed between the tool head and the elongate body. The elastic ring is loaded in compression axially biasing the tool head and the attached driveshaft in a direction away from the elongate body.

11 Claims, 2 Drawing Sheets

SANDER VIBRATION ISOLATOR

TECHNICAL FIELD

This invention relates to power tools such as sanders or the like which have a pivotally oscillating rotary output shaft.

BACKGROUND ART

Various sanders have been disclosed in prior art publications which have a pivotally oscillating output shaft, namely, U.S. Pat. No. 4,920,702 (Klaus et al) and published PCT patent application No. PCT/US93/07589 (Everts et al) (FIG. 16 embodiment) which is incorporated by reference herein. These sanders employ generally triangular heads which are centrally mounted on the center line of the pivotally oscillating output shaft. The central orientation of the driveshaft axis relative to the triangular sanding pad results in a balanced movement. However, the sanding pad does not extend very far beyond the front of the housing, limiting the use of the tool in tight places. In order to located the pad forward of the housing, sanding pads have been located on the ends of centrally pivoted levers as shown in U.S. Pat. No. 2,350,098 (Decker) as well as in FIGS. 2–3 of the previously cited Everts et al PCT application, which is commercially known as the Ryobi DS1000 sander.

The present invention is incorporated in a sander having a pivotally oscillating output shaft. However, the sanding head is located completely forward of the pivot axis. This design enables the driveshaft to be supported on a pair of spaced apart bearings, while having the sanding pad located forward of the tool body so that it can reach into tight places.

A problem originally faced when designing the present invention was that the sanding head vibrated, affecting sanding performance and causing unwanted noise. The sanding head, when viewed with a strobe light, cyclically wobbled out of plane, much the same way a coin spinning on edge wobbles as it slows to a stop.

SUMMARY OF THE INVENTION

It is an object of the present invention to provide a vibration stabilizer for a sander having a pivotally oscillating output shaft.

It is another object of the invention to provide an air- and dust-tight seal between the sanding head and tool body to facilitate the incorporation of a dust collection conduit extending from the oscillating sanding head to the tool body.

It is yet another object of the present invention to reduce the noise generated by the sanding tool when in use.

An unexpected benefit achieved by the present invention is that motor free speed is increased and current draw is decreased presumably as a result of decreased bearing loads and more efficient operation.

Accordingly, a power tool such as a sander or the like is provided having a central pivotally oscillating driveshaft projecting from an elongate body which defines an internal cavity aligned along a longitudinal axis. The driveshaft is supported relative to the elongate body and pivotally rotatable about a pivot axis. A drive motor, positioned within the elongate body internal cavity, operatively engages the driveshaft to cause the driveshaft to pivotally oscillate within a limited angular range when the motor is energized. A tool head is affixed a free end of the driveshaft. An elastic ring is positioned about the driveshaft interposed between the tool head and the elongate body. The elastic ring is loaded in compression axially biasing the tool head in the attached driveshaft in a direction away from the elongate body, thereby minimizing vibration and noise generated when the motor is energized.

The utility and additional features of this invention will be more clearly apparent from the following detailed description of the preferred embodiment and a review of the accompanying drawings.

BEST MODE FOR CARRYING OUT THE INVENTION

Figure 1:
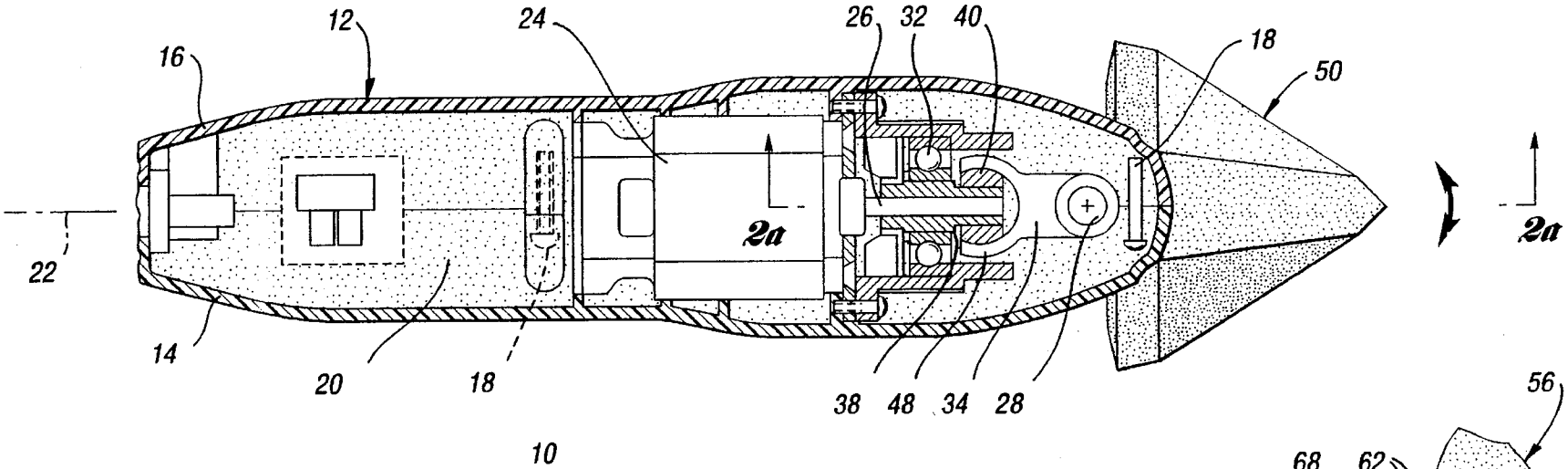
FIG. 1 is a cross-sectional plan view of a sander employing the present invention.
Figure 3:
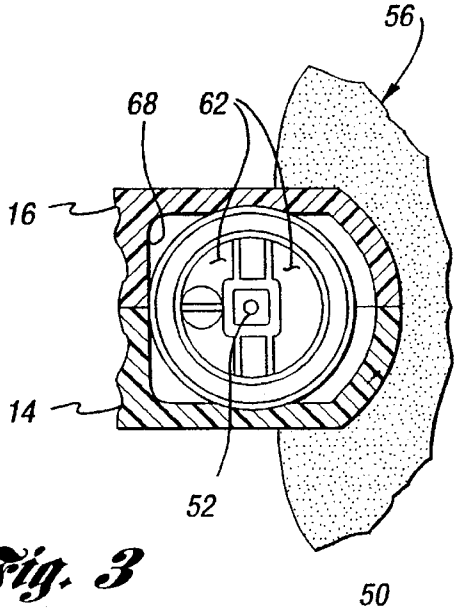
FIG. 3 is a cross-sectional plan view taken along section line 3—3 of FIG. 2*b* with the elastic ring not shown for illustration purposes.

A sander 10 of the present invention is illustrated in FIGS. 1–3. Sander 10 is made up of an elongate body 12 formed by complementary right and left body portions 14 and 16. Right and left body portions are held together by a series of screws representatively illustrated by screws 18. Elongate body 12 defines an internal cavity 20 which extends along a central longitudinal axis 22. Oriented within the body internal cavity 20 and generally aligned with longitudinal axis 22 is drive motor 24. The drive motor is provided with a rotary output shaft 26 which is operatively connected to pivotally oscillating driveshaft 28. Driveshaft 28 is supported on the elongate body pivotally rotatable about pivot axis 30.

In the preferred embodiment illustrated, pivot axis 30 is orthogonal to longitudinal axis 22. However, it should be appreciated that pivot axis 30 could be offset from longitudinal axis 22 in plan view or inclined relative to the longitudinal axis side view without departing from the spirit and scope of the present invention. Driveshaft 22 is pivotally supported on body 12 by a pair of spaced apart bearings, namely, upper bushing 31 and roller bearing 32. Bushing 31 and roller bearing 32 are held in corresponding semi-cylindrical pockets formed in right and left housing portions 14 and 16. Roller bearing 32 is provided with an inner race which is affixed to the shaft and prevented from moving axially. Roller bearing 32 is preferably a conventional sealed roller ball bearing which thereby prevents dust and debris from entering into the body internal cavity 20.

Pivot arm 34 is affixed to driveshaft 28 and extends rearwardly therefrom, as illustrated in FIGS. 1 and 2. The free end of pivot arm 34 is provided with a generally C-shaped opening. Motor 24 is provided with a rotary output shaft 26 connected to eccentric crank assembly 38. Eccentric crank assembly is pivotally supported on housing 12 by roller bearing 40. The eccentric crank assembly also includes a cooling fan 42 and an offset crank pin 44 supporting rolling ring 46. Rolling ring 46 is sized to fit within the C-shaped opening in the free end 36 of pivot arm 34. As motor 24 is driven, motor output shaft rotates the eccentric crank assembly. Crank pin 44 which is parallel to and radially offset from the longitudinal axis 22 drives roller ring in an orbital motion, causing the free end 36 of pivot arm 34 to oscillate back and forth, thereby pivotally rotationally oscillating driveshaft 28 through a small included angle. Preferably, this angle is in the 1 to 7 degree range, and most preferably, in the 2 to 3 degree range.

Driveshaft 28 is provided with a non-circular free end 48 which, in the preferred embodiment, is square in cross-section. Driveshaft free end 48 is adapted to removably receive a tool head assembly 50 which has a corresponding square opening 52 sized to cooperate with the driveshaft free end to drive the tool head assembly in a pivotally oscillating manner.

Tool head assembly 50 has a mounting boss portion 54 which structurally forms square opening 52. Tool head assembly 50 also includes a forward head portion 56 which, in the embodiment illustrated, is generally triangular in shape and designed to receive the standard nine-sided sanding pads utilized in the Ryobi DS1000 sander. Interposed between head 56 and sand paper sheet 58 is an elastic pad 60 which provides both a generally flat, soft planar surface for adhering the sand paper 58, but also spans the internal ribs molded into head 56. Head 56 is provided with an internal dust collection passageway 62 and extends from a series of intake ports adjacent the outer peripheral edge of head 56 to a region outboard of the driveshaft (illustrated in FIG. 3).

Internal dust collection passageway 62 in head 56 is in fluid communication with an internal dust collection conduit 64 formed within body 12. The dust collection conduit 44 extends from a region immediately surrounding driveshaft 28 to an external dust collection port 66. Dust collection port 66 serves as a sight for the attachment of an external dust collection line to evacuate dust debris away from the sanding head 56 when in operation.

Figure 2A:
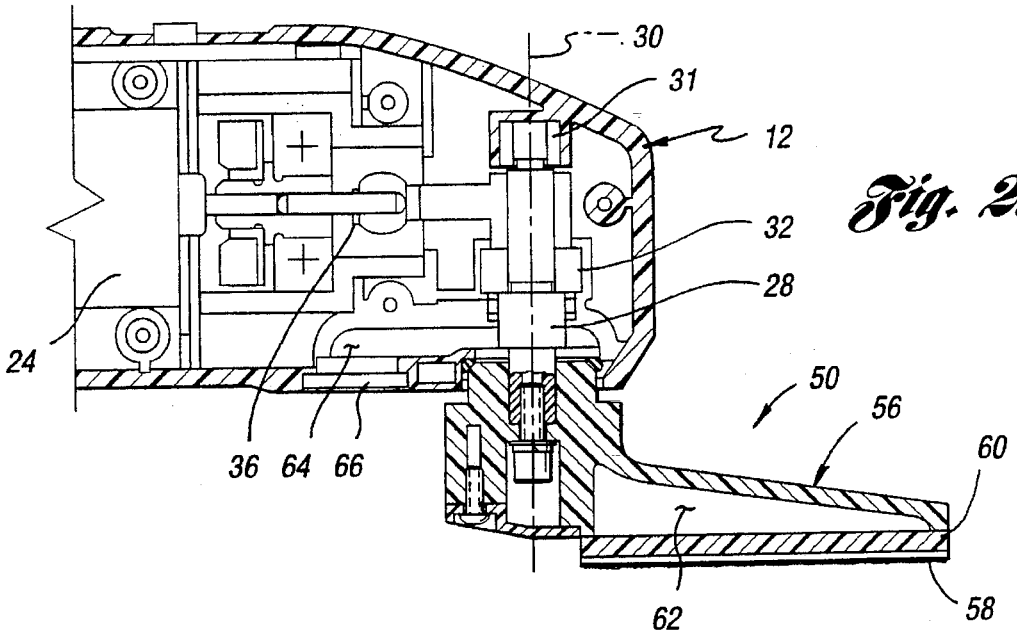
FIG. 2*a* is a cross-sectional side elevation of the forward portion of the sander employing the present invention.
Figure 2B:
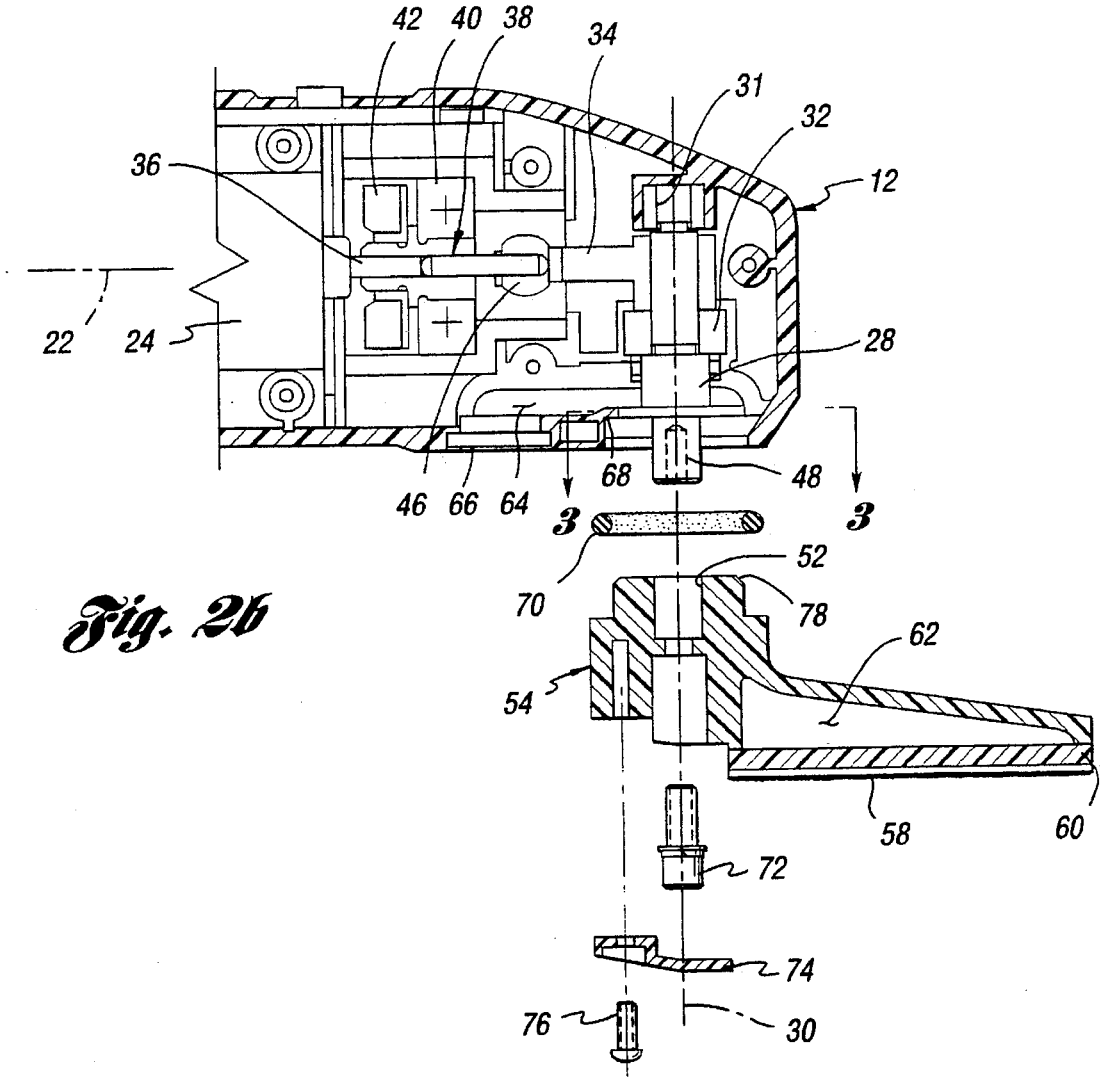
FIG. 2*b* is an exploded view of the sander shown in FIG. 2*a* with the head and elastic ring detached from the tool driveshaft.

The body 12 forms a pocket 68 which extends circumferentially about driveshaft free end 48. Pocket 68 is sized to receive elastic ring 70 which is interposed between body 12 and head assembly 50. Elastic ring 70 is loaded in compression axially, thereby biasing tool head assembly 50 away from body 12. Tool head assembly 50 is securely mounted to the free end of driveshaft 28 by socket-head cap screw 72, which extends through an axial hole in mounting boss 54 and cooperates with an axial threaded bore in driveshaft 28. As illustrated in FIGS. 2*a* and 2*b*, cover 74 is affixed to a mounting boss 54 by screws 76 after the head assembly is secured to the driveshaft. Cover 74 sealingly cooperates with mounting boss 54 to define internal dust collection passageway 62 within head assembly 50.

Mounting boss portion 54 of head assembly 50 is provided with a circumferential face 78 adapted to cooperate with elastic ring 70. In the preferred embodiment illustrated, face 78 is frustoconical in shape inwardly tapering at an angle which is approximately 45 degrees relative to pivot axis 30. In addition to be loaded axially, elastic ring 70 is loaded radially, at least locally, thereby helping to reduce radial deflection of the driveshaft 28 relative to the housing when the tool is in use.

As illustrated in FIG. 3, pocket 68, while circular at its lowermost opening, is non-circular in the region of elastic ring 70. When the elastic ring is installed and loaded, deformation is greatest in three locations. Those regions perpendicular to longitudinal axis 22 and a region aligned with the longitudinal axis 22 immediately rearward of pivot axis 30. By limiting the maximum deformation to these limited regions where it is needed the most to stabilize the vibrating tool head assembly, and minimizing the deformation of elastic ring 70 and other areas, frictional losses can be minimized.

Elastic ring 70, in the preferred embodiment, is circular in cross-section. However, it should be appreciated that other cross-sectional shapes such as square, oval or triangular rings, could be utilized as well. In the preferred embodiment, elastic ring 70 is formed of silicon rubber as opposed to conventional low cost O-ring material in order to reduce the likelihood of damage to the elastic ring resulting from heat generated from friction. In the preferred embodiment, elastic ring 70 has a free outer diameter of 1.125 inches (28.575 mm) and a free inside diameter of 0.859 inches (21.8186 mm), resulting in a cross-sectional diameter of 1.39 inches (35.306 mm). Elastic ring 70 preferably has a durometer of 65–75 on the Shore A scale, and most preferably, a durometer of 70 Shore A.

The elastic ring 70 is compressed locally in the regions of maximum compression much greater than is typically done in a conventional O-ring installation. From the point at which elastic ring 70 is initially contacting both frustoconical face 78 and the uppermost surface of pocket 68, tool head assembly 50 is moved a distance with approximately ½ elastic ring diameter or approximately 0.070 inches (1.778 mm).

As previously described, the load exerted by the O-ring axially biases tool head assembly 50 and the attached driveshaft 28 away from tool body 12. This axial load takes up any slack which may exist in roller bearing 32, which has its inner race affixed to driveshaft 28 and its outermost race cooperating with the pocket formed in body 12 as illustrated in FIGS. 2*a* and 2*b*. The elastic ring 70 has proven to be very effective in stabilizing the vibration of the tool head assembly 50 relative to the body when the tool is in operation. When the sanding tool of the present invention is operated with the elastic ring removed, noise and vibration in motor current draw increase and free motor speed decreases. It is believed that the vibration causes increased friction on roller bearing 32 and bushing 30, resulting in the decrease in motor speed. The installation of the elastic ring, in spite the friction between the tool head assembly and the body results in a net in the decrease in motor load. The change of performance is significant and the vibration and noise reduction resulting from the use of the elastic ring described is readily perceptible to the tool operator.

While the best mode for carrying out the invention has been described in detail, those familiar with the art to which this invention relates will recognize various alternative designs and embodiments for practicing the invention as defined by the following claims.

What is claimed is:

1. A power tool having a pivotal oscillating driveshaft, said power tool comprising:

an elongate body defining an internal cavity aligned along a longitudinal axis;

a driveshaft supported upon the elongate body and pivotally rotatable about a pivot axis, the driveshaft having a free end;

a drive motor oriented within the body internal cavity and operatively engaging the driveshaft to cause the driveshaft to pivotally oscillate within a limited angular range when the drive motor is energized;

a tool head affixed to the driveshaft free end;

an elastic ring extending about the driveshaft and interposed between the tool head and the elongate body, said elastic ring being loaded in compression axially biasing the tool head and the attached driveshaft in a direction away from the elongate body thereby minimizing vibration and noise generated when the drive motor is energized; and wherein the elastic ring is radially compressed between the elongate body and the tool head in two diametrically opposed local regions which are alternatively loaded as the tool head pivotally oscillates in use.

2. The tool of claim 1 wherein said elastic ring in the free state has a circular cross-section.

3. The tool of claim 1 wherein said elastic ring is formed of silicone rubber having a durometer of about 60–75 Shore A.

4. The tool of claim 1 wherein said elastic ring is axially compressed at least 40% of its free axial height.

5. The tool of claim 1 wherein said tool holder is provided with an annular frustoconical surface inwardly tapering in the direction of the elongate body said frustoconical surface co-operating with the elastic ring to compress the elastic ring between the tool holder and the elongate body.

6. The tool of claim 1 wherein said tool head is provided with a generally triangular planar sanding surface perpendicular to the driveshaft and oriented completely forward of the driveshaft pivot axis.

7. The tool of claim 1 wherein said tool head is further provided with an internal dust collection passageway and said elongate body is provided with an internal dust collection port in fluid communication with the internal dust collection passageway in the tool head.

8. A sander comprising:

an elongate body defining an internal cavity aligned along a longitudinal axis;

a driveshaft supported upon the elongate body by a pair of spaced apart bearings and pivotally rotatable relative to the elongate body about a pivot axis extending generally perpendicular to said longitudinal axis, the driveshaft provided with a free end projecting from the elongate body;

a drive motor pointed within the body internal cavity and operatively engaging the driveshaft to cause the driveshaft to pivotally oscillate back and forth within a limited angular range when the drive motor is energized;

a tool head assembly affixed to the driveshaft free end, said tool head assembly having a mounting boss adapted to be removably affixed to the driveshaft free end and a generally triangular sanding head portion having a generally planar sand paper support surface which is perpendicular to the pivot axis and located forward thereof;

an annular elastic ring of circular cross-section extending about the driveshaft and interposed between the tool head and elongated body, said elastic ring being loaded in the compression axially, thereby biasing the tool head and the attached driveshaft in a direction away from the elongate body, thereby minimizing vibration and noise generated when the drive motor is energized; and wherein the elastic ring is radially compressed between the elongate body and the tool head in two diametrically opposed local regions which are alternatively loaded as the tool head pivotally oscillates in use.

9. The tool of claim 8 wherein said elastic ring is formed of silicone rubber having a durometer of about 60–75 Shore A.

10. The tool of claim 8 wherein said elastic ring is axially compressed at least 40% of its free axial height.

11. The tool of claim 8 wherein said tool holder is provided with an annular frustoconical surface inwardly tapering in the direction of the elongate body said frustoconical surface co-operating with the elastic ring to compress the elastic ring between the tool holder and the elongate body.

* * * * *